US006180306B1

(12) United States Patent
Yoon et al.

(10) Patent No.: US 6,180,306 B1
(45) **Date of Patent: *Jan. 30, 2001**

(54) SOLUTION FOR MAKING A PHOTOCONDUCTIVE LAYER IN DRY-ELECTROPHOTOGRAPHICALLY MANUFACTURING A SCREEN OF A CRT AND METHOD FOR DRY-ELECTROPHOTOGRAPHICALLY MANUFACTURING THE SCREEN USING THE SOLUTION

(75) Inventors: Sang Youl Yoon, Kyungsangbuk-do; Ho Seok Shon, Seoul, both of (KR)

(73) Assignee: Orion Electric Co., Ltd., Kyungsangbuk-Do (KR)

( * ) Notice: Under 35 U.S.C. 154(b), the term of this patent shall be extended for 0 days.

This patent is subject to a terminal disclaimer.

(21) Appl. No.: 09/380,368

(22) PCT Filed: Dec. 31, 1997

(86) PCT No.: PCT/KR97/00288

§ 371 Date: Aug. 31, 1999

§ 102(e) Date: Aug. 31, 1999

(87) PCT Pub. No.: WO99/34384

PCT Pub. Date: Jul. 8, 1999

(51) Int. Cl.[7] ..... G03G 5/04
(52) U.S. Cl. ..... 430/70; 430/28

(58) Field of Search ..... 430/70, 135, 28

(56) References Cited

U.S. PATENT DOCUMENTS

| | | | | |
|---|---|---|---|---|
| 4,105,447 | * | 8/1978 | Fox | 430/70 |
| 4,912,002 | * | 3/1990 | Ishibashi et al. | 430/76 |
| 5,405,722 | * | 4/1995 | Datta et al. | 430/28 |
| 6,040,097 | * | 3/2000 | Yoon et al. | 430/28 |

OTHER PUBLICATIONS

"Radical Ions in Photochemistry. Carbon–Carbon Bond Cleavage of Radical Cations in Solution: Theory and Application." J. Am. Chem. Soc. 112, pp. 3068–3082, 1990.*

* cited by examiner

*Primary Examiner*—Christopher D. RoDee
(74) *Attorney, Agent, or Firm*—Notaro & Michalos P.C.

(57) ABSTRACT

Disclosed are a solution for making a photoconductive layer in dry-electrophotographically manufacturing a screen of a cathode ray tube and a method using solution. By the solution, the photoconductive layer can be stored for long time and reveals a superior photoconductivity. The solution has tetraphenyl ethylene derivatives as an electron donor material responsive to the ultraviolet rays, which has structural formula (I), in which R is H, $CH_3$, $C_2H_5$, $C_3H_7$, $OCH_3$, $OC_2H_5$, $OC_3H_7$, or $COCH_3$, on a condition of excepting a case where $R_1=R_2=R_3=R_4=H$.

1 Claim, 2 Drawing Sheets

SOLUTION FOR MAKING A PHOTOCONDUCTIVE LAYER IN DRY-ELECTROPHOTOGRAPHICALLY MANUFACTURING A SCREEN OF A CRT AND METHOD FOR DRY-ELECTROPHOTOGRAPHICALLY MANUFACTURING THE SCREEN USING THE SOLUTION

FIELD OF THE INVENTION

The present invention relates to a solution for making a photo-conductive layer in dry-electrophotographically manufacturing a screen of a cathode ray tube (CRT) and a method for dry-electrophotographically manufacturing the screen using the solution, which can improve the photo-conductivity of the photo-conductive layer to save energy and at the same time increase the developing density and reduce the change-to-time-passage of the powdered phosphor particles, so that the photo-conductive layer can maintain superior photo-conductivity even after it has been stored for long time.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14, and a shadow mask 16 removably mounted to an inner sidewall of the panel 12. A three color phosphor screen is formed on the inner surface of a display window or faceplate 18 of the panel 12.

The electron gun 11 generates three electron beams 19*a* or 19*b*, said beams being directed along convergent paths through the shadow mask 16 to the screen 20 by means of several lenses of the gun and a high positive voltage applied through an anode button 15 and being deflected by a deflection yoke 17 so as to scan over the screen 20 through-apertures or slits 16*a* formed in the shadow mask 16.

In the color CRT 10, the phosphor screen 20, which is formed on the inner surface of the faceplate 18, comprises an array of three phosphor elements R, G and B of three different emission colors arranged in a cyclic order of a predetermined structure of multiple-stripe or multiple-dot shape and a matrix of light-absorptive material 21 surrounding the phosphor elements R, G and B, as shown in FIG. 2.

A thin film of aluminum 22 or electro-conductive layer, overlying the screen 20 in order to provide a means for applying the uniform potential applied through the anode button 15 to the screen 20, increases the brightness of the phosphor screen, prevents ions from damaging the phosphor screen and prevents the potential of the phosphor screen from decreasing. And also, a resin film 22' such as lacquer is applied to the phosphor screen 20 before forming the aluminum thin film 22, so as to enhance the flatness and reflectivity of the aluminum thin film 22.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments with the use of a large quantity of clean water, thereby necessitating high cost in manufacturing the phosphor screen. In addition, it discharges a large quantity of effluent such as waste water, phosphor elements, 6th chrome sensitizer, etc.

To solve or alleviate the above problems, an improved process of electro-photographically manufacturing the screen utilizing dry-powdered phosphor particles is developed.

U.S. Pat. No. 4,921,767, issued to Datta at al. on May 1, 1990, discloses the improved method of electro-photographically manufacturing the phosphor screen assembly using dry-powdered phosphor particles through a series of steps represented in FIGS. 3A to 3E, as is briefly explained in the following.

After the panel 12 is washed, an electro-conductive layer 32 is coated on the inner surface of the faceplate 18 of the panel 12 and the photo-conductive layer 34 is coated thereon, as shown in FIG. 3A. Conventionally, the electro-conductive layer 32 is made from an inorganic conductive material such as tin oxide or indium oxide, or their mixture, and preferably, from a volatilizable organic conductive material such as a polyelectrolyte commercially known as polybrene(1,5-dimethyl-1,5-diaza-undecamethylene polymethobromide, hexadimethrine bromide), available from Aldrich Chemical Co.

The polybrene is applied to the inner surface of the faceplate 18 in an aqueous solution containing about 10 percent by weight of propanol and about 10 percent by weight of a water-soluble adhesion-promoting polymer (poly vinyl alcohol, polyacrylic acid, polyamide and the like), and the coated solution is dried to form the conductive layer 32 having a thickness from about 1 to 2 microns and a surface resistivity of less than about $10^8$ Ω/□ (ohms per square unit).

The photo-conductive layer 34 is formed by coating the conductive layer 32 with a photo-conductive solution comprising a volatilizable organic polymeric material, a suitable photo-conductive dye and a solvent. The polymeric material is an organic polymer such as polyvinyl carbazole, or an organic monomer such as n-ethyl carbazole, n-vinyl carbazole or tetraphenylbutatriene dissolved in a polymeric binder such as polymethylmethacrylate or polypropylene carbonate. The photo-conductive composition contains from about 0.1 to 0.4 percent by weight such dyes as crystal violet, chloridine blue, rhodamine EG and the like, which are sensitive to the visible rays, preferably rays having wavelength of from about 400 to 700 nm. The solvent for the photo-conductive composition is an organic matter such as chlorobenzene or cyclopentanone and the like which will produce as little contamination as possible on the conductive layer 32. The photo-conductive layer 34 is formed to have a thickness from about 2 to 6 microns.

FIG. 3B schematically illustrates a charging step, wherein the photo-conductive layer 34 overlying the electro-conductive layer 32 is positively charged in a dark environment by a conventional positive corona discharger 36. As shown, the charger or charging electrode of the discharger 36 is positively applied with direct current while the negative electrode of the discharger 36 is connected to the electro-conductive layer 32 and grounded. The charging electrode of the discharger 36 travels across the layer 34 and charges it with a positive voltage in the range from +200 to +700 volt.

FIG. 3C schematically shows an exposure step, wherein the charged photo-conductive layer 34 is exposed through a shadow mask 16 by a xenon flash lamp 35 having a lens system 35' in the dark environment. In this step, the shadow mask 16 is installed on the panel 12 and the electro-conductive layer 32 is grounded. When the xenon flash lamp 35 is switched on to shed light on the charged photoconductive layer 34 through the lens system 35' and the shadow mask 16, portions of the photo-conductive layer 34 corresponding to apertures or slits 16*a* of the shadow mask 16 are exposed to the light. Then, the positive charges of the exposed areas are discharged through the grounded conductive layer 32 and the charges of the unexposed areas remain in the photo-conductive layer 34, thus establishing a latent charge image in a predetermined array structure, as shown in FIG. 3C. In order to exactly attach light-absorptive materials, it is preferred that the xenon flash lamp 35 travels along three positions while coinciding with three different incident angles of the three electron beams.

FIG. 3D schematically shows a developing step which utilizes a developing container 35" containing dry-powdered light-absorptive or phosphor particles and carrier beads for producing static electricity by coming into contact with the dry-powdered particles. Preferably, the carrier beads are so mixed as to charge the light-absorptive particles with negative electric charges and the phosphor powders with positive electric charges when they come into contact with the dry-powdered particles.

In this step, the panel 12, from which the shadow mask 16 is removed, is put on the developing container 35" containing the dry-powdered particles, so that the photo-conductive layer 34 can come into contact with the dry-powdered particles. In this case, the negatively charged light-absorptive particles are attached to the positively charged unexposed areas of the photo-conductive layer 34 by electric attraction, while the positively charged phosphor particles are repulsed by the positively charged unexposed areas but attached by reversal developing to the exposed areas of the photo-conductive layer 34 from which the positive electric charges are discharged.

FIG. 3E schematically represents a fixing-step by means of infrared radiation. In this step, the light-absorptive and phosphor particles attached in the above developing step are fixed together and onto the photo-conductive layer 34. Therefore, the dry-powdered particles includes proper polymer components which may be melted by heat and have proper adhesion.

The steps of charging, exposing, developing and fixing are repeated for the three different phosphor particles. Moreover, the same process of the above steps can be repeated also for the black matrix particles before or after the three different phosphor particles are formed.

After the three different phosphor particles and the black matrix particles are formed through the above process, a lacquer film is formed through a lacquering step and an aluminum thin film is formed through an aluminizing step respectively by a conventional method. Thereafter, the face-plate panel 12 is baked in air at a temperature of 425° C., for about 30 minutes to drive off the volatilizable constituents such as the organic solvents from the conductive layer 32, the photo-conductive layer 34, the phosphor elements and the lacquer film, thereby forming a screen array 20 of light-absorptive material 21 and three phosphor elements R, G and B in FIG. 2.

The conventional method of electro-photographically manufacturing the phosphor screen assembly using dry-powdered phosphor particles as described above has one problem that it requires dark environment during all the steps until the fixing step after the photo-conductive layer is formed, because the photo-conductive layer is sensitive to the visual light. Also, the fixing step of FIG. 3E is still necessary even after the developing step.

To overcome this problem, the applicant proposed a method of forming the photo-conductive layer using a photo-conductive solution responsive to the ultraviolet rays.

The solution for the photo-conductive layer 34 responsive to the ultraviolet rays, for example, may contain: an electron donor material, such as about 0.01 to 1 percent by weight of bis-1,4-dimethyl phenyl(-1,4-diphenyl(butatriene)) or 2 to 5 percent by weight of tetraphenyl ethylene (TPE); an electron acceptor material, such as about 0.01 to 1 percent by weight of at least one of trinitro-fluorenone (TNF) and ethyl anthraquinone (EAQ); a polymeric binder, such as 1 to 30 percent by weight polystyrene; and a solvent such as the remaining percent by weight of toluene or xylene.

As the polymeric binder, poly(α-methylstyrene) (PαMS), polymethylmethacrylate (PMMA), and polystyrene-oxazoline copolymer (PS-OX) may be employed instead of the polystyrene.

However, since the aforementioned 2 to 5 percent by weight of tetraphenyl ethylene (TPE) as an electron donor material has a high recrystallization speed and a large aging effect, it can not be used after 24 hours passed. The reason of the high recrystallization speed and a large aging effect are assumed that the TPE has a plane molecular structure, so that it is laminated to form the photo-conductive layer 34 mainly when applied while it coheres after having been dissolved.

The present invention has been made to overcome the above described problems, and thereby it is an object of the present invention to provide a solution for making a photo-conductive layer in dry-electrophotographically manufacturing a screen of a CRT and a method for dry-electrophotographically manufacturing the screen using the solution, which can improve the photo-conductivity of the photo-conductive layer to save energy and at the same time increase the developing density of the powdered phosphor particles and reduce the aging effect, so that the photo-conductive layer can maintain a superior photo-conductivity even after it has been stored for long time.

SUMMARY OF THE INVENTION

To achieve the above objects, the present invention provides a solution for making a photo-conductive layer employed in a method for electro-photographically manufacturing a screen of a CRT utilizing dry-powdered phosphor particles, the method comprising the steps of:

forming a volatile conductive layer on an inner surface of a panel;

forming a volatile photo-conductive layer on the volatile conductive layer, the volatile photo-conductive layer containing a material responsive to ultraviolet rays;

charging the volatile photo-conductive layer with uniform electrostatic charges; exposing the volatile photo-conductive layer to a ultraviolet ray source, so as to selectively discharge the electrostatic charges from the volatile photo-conductive layer; and attaching the dry-powdered phosphor particles charged with electrostatic charges to the volatile photo-conductive layer;

wherein the solution comprises tetraphenyl ethylene derivatives as an electron donor material responsive to the ultraviolet rays, which has a following structural formula,

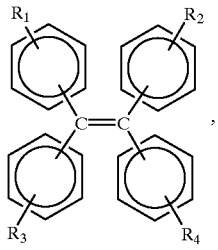

in which R is H, $CH_3$, $C_2H_5$, $C_3H_7$, $OCH_3$, $OC_2H_5$, $OC_3H_7$, or $COCH_3$, on a condition of excepting a case where $R_1=R_2=R_3=R_4=H$.

The present invention further provides a method for electro-photographically manufacturing a screen of a CRT utilizing dry-powdered phosphor particles, the method employing the above described solution for making a photo-conductive layer, the method comprising the steps of:

forming a volatile conductive layer on an inner surface of a panel;

forming a volatile photo-conductive layer on the volatile conductive layer, the volatile photo-conductive layer containing a material responsive to ultraviolet rays;

charging the volatile photo-conductive layer with uniform electrostatic charges;

exposing the volatile photo-conductive layer to an ultraviolet ray source, so as to selectively discharge the electrostatic charges from the volatile photo-conductive layer; and attaching the dry-powdered phosphor particles charged with electrostatic charges to the volatile photo-conductive layer.

BRIEF DESCRIPTION OF THE DRAWINGS

The above object, and other features and advantages of the present invention will become more apparent by describing in detail preferred embodiments thereof with reference to the attached drawings, in which.

DETAILED DESCRIPTION OF THE PREFERRED EMBODIMENTS

Hereinafter, a preferred embodiment of the present invention will be described in detail with reference to the attached drawings.

A solution for making a photo-conductive layer according to the present invention is employed in a method for electro-photographically manufacturing a screen of a CRT utilizing dry-powdered phosphor particles, the method including the steps of: forming a volatile conductive layer 32 on an inner surface of a panel similarly to that shown in FIGS. 3A to 3E; forming a volatile photo-conductive layer 34 on the volatile conductive layer 32, the volatile photo-conductive layer 34 containing material responsive to ultraviolet rays; charging the volatile photo-conductive layer 34 with uniform electrostatic charges; and exposing the volatile photo-conductive layer 34 to a light source, so as to selectively discharge the electrostatic charges from the volatile photo-conductive layer 34, thereby attaching powdered particles charged with the electrostatic charges to the volatile photo-conductive layer 34.

The solution for making the photo-conductive layer 34 includes tetraphenyl ethylene (TPE) derivatives as an electron donor material, which has a following structural formula,

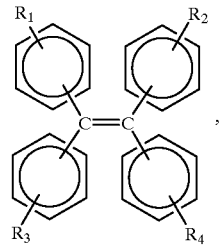

wherein R is H, $CH_3$, $C_2H_5$, $C_3H_7$, $OCH_3$, $OC_2H_5$, $OC_3H_7$, or $COCH_3$, on a condition of excepting a case where $R_1=R_2=R_3=R_4=H$.

As an example, the photo-conductive layer 34 is formed with a thickness of $4\mu$ on the volatile conductive layer 32 of the panel 12 by making a photo-conductive solution which has the following composition. That is, the above tetraphenyl ethylene together with trinitro-fluorenone (TNF), ethyl anthraquinone (EAQ) and polystyrene-oxazoline copolymer (PS-OX) is dissolved in toluene to form the solution for making the photo-conductive layer 34, wherein the polystyrene-oxazoline copolymer is 10% by weight of toluene and the tetraphenyl ethylene is 20% by weight of polystyrene-oxazoline copolymer, and the trinitro-fluorenone and the ethyl anthraquinone are respectively 10% by weight of the tetraphenyl ethylene.

Figures 3A, 3B, 3C, 3D, 3E:
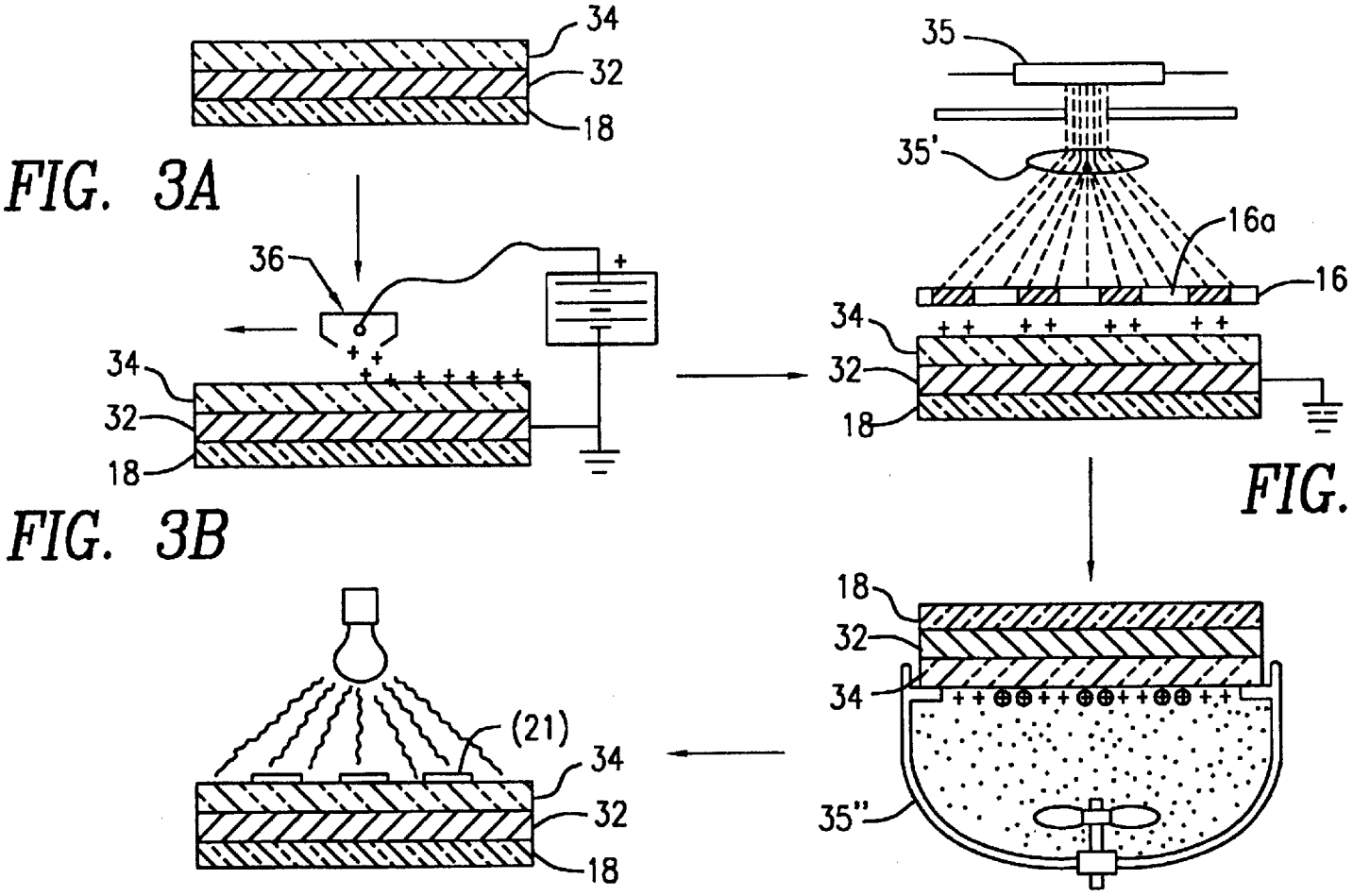
FIGS. 3A through 3E are schematic sectional views for showing various steps in the method for dry-electrophotographically manufacturing the screen using the solution of the present invention.

Thereafter, the panel 12 on which the photo-conductive layer 34 is formed as described above is subjected to a charging step similarly to that shown in FIG. 3B. Then, the panel 12 with the photo-conductive layer 34 has revealed no problem of developing in exposing step even after forty eight hours. This means that the tetraphenyl ethylene derivative shows a small aging effect and therefore it can be used even after long time has passed. The reason for this can be explained as follows: while the tetraphenyl ethylene, in which $R_1=R_2=R_3=R_4=H$, has a plane molecular structure, the tetraphenyl ethylene, in which at least one of the four R's is replaced by H, $CH_3$, $C_2H_5$, $C_3H_7$, $OCH_3$, $OC_2H_5$, $OC_3H_7$, or $COCH_3$, has a three-dimensional molecular structure to thereby reveal slow recrystallization speed due to its three-dimensional structure when its film is formed.

Meanwhile, after the panel 12 with the photo-conductive layer 34 is subjected to a charging and exposing steps similarly to those shown in FIGS. 3A to 3E, the potential difference between the exposed area and the unexposed area has been compared with that in the prior art.

That is, 350 volt has been applied in the charging step, and an ultraviolet lamp of 0.1 mW has shed ultraviolet rays through the shadow mask 16 for five seconds in the exposing step. Then, the following result has been obtained according to the $R_1$ to $R_4$.

In case where $R_1=CH_3$ and $R_2=R_3=R_4=H$, the potential difference between the exposed area and the unexposed area has been 220 volt. In case where $R_1=COCH_3$ and $R_2=R_3=R_4=H$, the potential difference has been 180 volt, and when $R_1=OC_3H_7$ and $R_2=R_3=R_4=H$, the potential difference has been 185 volt.

In the above structural formula, in case of the conventional tetraphenyl ethylene in which $R_1=R_2=R_3=R_4$, the potential difference between the exposed area and the unexposed area has been 150 volt after the same steps under the same conditions excepting the charging voltage of 300 volt.

Therefore, the photo-conductive layer applied by the solution which is formed by the tetraphenyl ethylene derivatives according to the present invention reveals an additional potential difference of at least 30 volt, which means a superior photo-conductivity, in comparison with the conventional photo-conductive layer.

The solution for making a photo-conductive layer according to the present invention is employed in the following method for electro-photographically manufacturing a screen of a CRT utilizing dry-powdered phosphor particles. That is, the method comprises the steps of: (1) forming a volatile conductive layer on an inner surface of a panel with a conventional organic conductive solution; (2) forming a volatile photo-conductive layer on the volatile conductive layer with the photo-conductive solution of the present invention; (3) charging the volatile photo-conductive layer with uniform electrostatic charges; (4) exposing the volatile photo-conductive layer through a shadow mask to a light source so as to selectively discharge the electrostatic charges from the volatile photo-conductive layer; and (5) developing the photo-conductive layer by charging powdered particles to be attached on one of an exposed area and an unexposed area of the photo-conductive layer.

In case of a color CRT, the above steps are repeated for the three different phosphor particles. Moreover, the same process of the above steps can be repeated also for the black matrix particles 21 before or after the three different phosphor particles are formed. In this case, the employed panel 12 may have an array of a predetermined pattern-of the black matrix particles 21 by a conventional wet slurry method.

Figure 1:
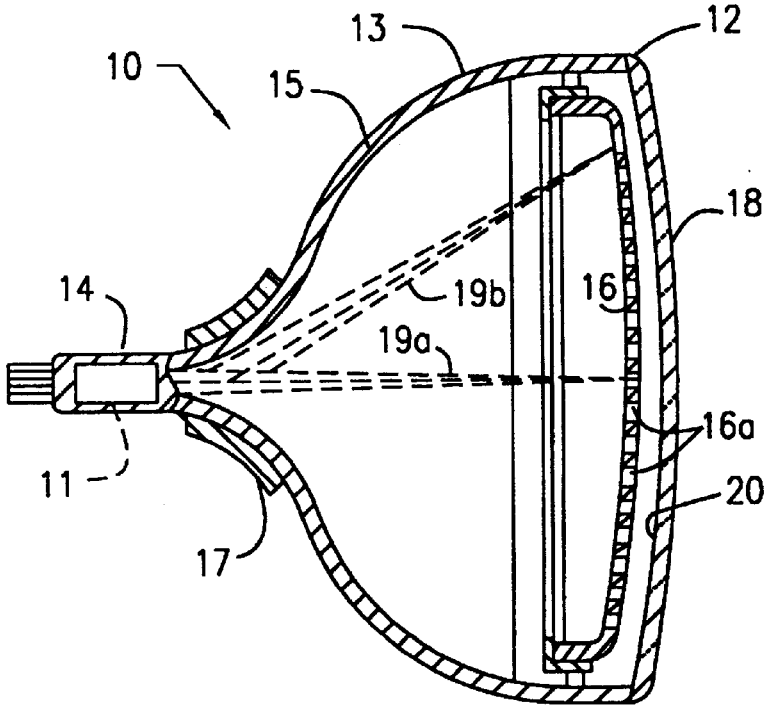
FIG. 1 is a plan view partially in axial section of a color cathode-ray tube.
Figure 2:
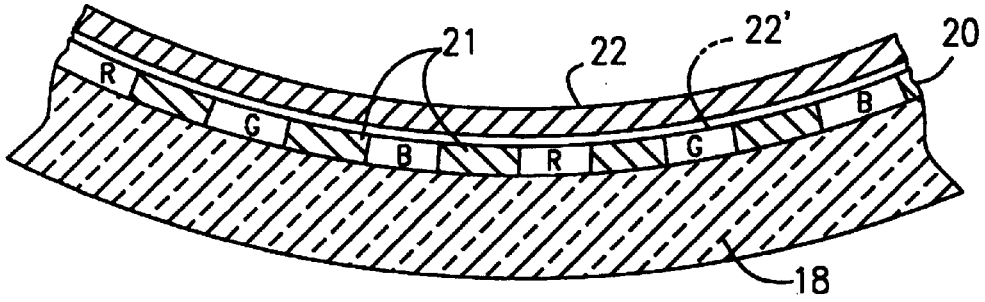
FIG. 2 is an enlarged partial sectional view of a screen assembly of the tube shown in FIG. 1.

After the three different phosphor particles and the black matrix particles are formed through the above process, a lacquer film or resin film 22' is formed through a lacquering step and an aluminum thin film is formed through an aluminizing step respectively by a conventional method. Thereafter, the faceplate panel 12 is baked in air at a temperature of 425° C., for about 30 minutes to drive off the volatilizable constituents such as the organic solvents from the conductive layer 32, the photo-conductive layer 34, the phosphor elements and the lacquer film, thereby forming a screen array 20 of light-absorptive material 21 and three phosphor elements R, G and B as shown in FIG. 2.

As described above, the photo-conductive layer 34 formed by the photo-conductive solution of the present invention reveals a superior electric characteristic or charging characteristic onto the photo-conductive layer 34. Moreover, the photo-conductive layer 34 not only can be stored for at least forty eight hours due to its three-dimensional molecular structure but also has a much improved photo-conductive characteristic due to the strong function as electron donor.

In the meantime, as the solvent for the photo-conductive solution, beside of toluene and xylene, benzene or benzene derivative may be used to dissolve the above-mentioned macro-molecular binder.

Moreover, in the developing step, instead of being charged by such contact as shown in FIG. 3D, the powdered particles may be charged by a contact with a pipe in the course of being supplied, or charged by a corona discharge just before being sprayed by a spray coater.

The fixing step as shown in FIG. 3E may employ a vapor swelling method wherein the fixing is performed by a contact with a solvent vapor such as acetone and methyl isobutyl ketone, or a spraying method wherein an electrostatic solution spray gun sprays a mixture of at two kinds among methyl isobutyl ketone, TCE, toluene, and xylene of the petroleum group on the developed powdered-particles of red, green, and blue. Otherwise, the fixing step may be omitted partly or totally.

As apparent from the above description, in the solution for making a photo-conductive layer in dry-electrophotographically manufacturing a screen of a CRT and a method for dry-electrophotographically manufacturing the screen using the solution, tetraphenyl ethylene derivative having three-dimensional molecular structure is employed as an electron donor material, so that the photo-conductive layer 34 may be used for long time of at least 48 hours and reveals a superior photo-conductivity. Therefore, by the solution of the present invention, the developing density may be further increased in the developing step.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A solution for making a photo-conductive layer employed in a method for electro-photographically manufacturing a screen of a cathode ray tube utilizing dry-powdered phosphor particles, the method comprising the steps of:

forming a volatile conductive layer on an inner surface of a panel;

forming a volatile photo-conductive layer on the volatile conductive layer, the volatile photo-conductive layer containing a material responsive to ultraviolet rays;

charging the volatile photo-conductive layer with uniform electrostatic charges; exposing the volatile photo-conductive layer to an ultraviolet ray source, so as to selectively discharge the electrostatic charges from the volatile photo-conductive layer; and attaching the dry-powdered phosphor particles charged with electrostatic charges to the volatile photo-conductive layer;

wherein the solution comprises a tetraphenyl ethylene derivative as an electron donor material responsive to the ultraviolet rays, which has a following structural formula,

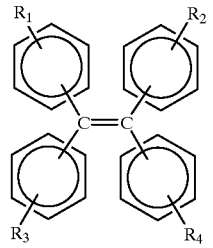

in which R is H, $CH_3$, $C_2H_5$, $C_3H_7$, $OCH_3$, $OC_2H_5$, $OC_3H_7$, or $COCH_3$, on a condition of excepting a case where $R_1=R_2=R_3=R_4=H$;

the tetraphenyl ethylene derivative being dissolved together with trinitro-fluorenone, ethyl anthraguinone and polystyrene-oxazoline copolymer in toluene to form the solution, in which the polystyreneoxazoline copolymer is 10% by weight of the toluene and the tetraphenyl ethylene derivative is 20% by weight of the polystyrene-oxazoline copolymer and the trinitrofluorenone and the ethyl anthraguinone are respectively 10% by weight of the tetraphenyl ethylene derivative.

* * * * *